United States Patent [19]

Jones

[11] Patent Number: 4,991,338

[45] Date of Patent: Feb. 12, 1991

[54] GOLF CLUB HEAD COVER WITH IDENTIFICATION TAG

[76] Inventor: George H. Jones, 13460 SW. Fielding Rd., Lake Oswego, Oreg. 97034

[21] Appl. No.: 293,633

[22] Filed: Jan. 5, 1989

[51] Int. Cl.[5] ..... G09F 3/20

[52] U.S. Cl. ..... 40/653; 40/642; 40/915; 150/160

[58] Field of Search ..... 40/5, 653, 915, 642, 40/634, 649; 150/160

[56] References Cited

U.S. PATENT DOCUMENTS

| | | | |
|---|---|---|---|
| 141,205 | 7/1873 | Curless | 40/5 |
| 206,244 | 7/1878 | Johnson | 40/5 |
| 1,528,657 | 3/1925 | Darkins | 40/5 |
| 3,492,746 | 2/1970 | Hauck | 40/299 |
| 3,574,963 | 4/1971 | Rosenow | 40/5 |
| 4,520,855 | 6/1985 | Dien | 150/160 |
| 4,667,716 | 5/1987 | Solheim et al. | 150/52 |
| 4,674,628 | 6/1987 | Prinsloo et al. | 40/653 X |

*Primary Examiner*—Kenneth J. Dorner
*Assistant Examiner*—Joanne Bonifanti
*Attorney, Agent, or Firm*—Chernoff, Vilhauer, McClung & Stenzel

[57] ABSTRACT

A club head cover and a tag attached thereto for identifying a covered golf club. Multiple label plates are contained in face-to-face arrangement within a label plate holder defining a window through which a label located on one side of the label plates is displayed. The label plates are releasably latched into the holder and are symmetrically shaped to permit placement into the holder with either face directed toward the window, so that either side of the label plate can be displayed.

6 Claims, 1 Drawing Sheet

GOLF CLUB HEAD COVER WITH IDENTIFICATION TAG

BACKGROUND OF THE INVENTION

The present invention relates to a golf club head cover equipped with a club identifying tag including interchangeable label plates which are stored within the tag.

Protective covers are often used on the heads of golf clubs, particularly woods, to avoid damage to the finish of such club heads, which might otherwise result from exposure to sun or rain or from striking against other club heads in a golf bag.

Club head covers have long been available with club numbers stencilled, embroidered, or appliqued on the outside of each individual head cover to identify the club. However, different players may use different combinations of woods, and those players using a smaller number of woods may choose not to bear the expense of purchasing a complete set of covers including covers for the heads of clubs which the particular player does not have. Nevertheless, identification is necessary for the individual clubs which a player does have in his or her bag.

Since a cover of a single design can function equally well on any wood club head, a suitable identification tag which can be changed to identify each of several differently-numbered clubs is practical. In the past, some tags have included a label holder and an assortment of labels, only one of which is intended to be placed in the holder at a time. The club head cover can then be used to identify a single club of the user's choice. The problem with such a tag is that the additional labels are likely to be lost and thus not be available should the user decide to use the cover for a different club.

Identification tags on personnel luggage, such as those used to contain a business card or similar identification card, usually include a strap to attach the tag to the handle of luggage, and removal and replacement of the identifying card is prevented by the strap when it remains in place. This difficulty of changing the information displayed in such a tag is increased with the passage of time, as a leather strap becomes swollen or stiff with exposure to weather, and plastic straps may become stiff or brittle with exposure to the sun. In either case, the need to remove a strap in order to change identifying material in such a tag makes it considerably less likely that an owner would attempt to change the identification of a golf club head cover equipped with such a tag.

What is needed, then, is a protective cover for a golf club head, including an identification tag which can be arranged easily to identify any of the clubs whose heads would normally be covered by the particular size of cover. The identification tag of such a club head cover should be changeable without difficulty to identify a different club of a similar type, if desired, throughout the life of the club head cover.

SUMMARY OF THE INVENTION

The present invention provides a protective cover for golf club heads, together with an attached tag of similar device for identifying a particular club protected by the cover, which normally obscures the club head.

In a preferred embodiment of the invention a sleeve-like club head cover is open at one end, permitting insertion of a golf club head, while the other end is closed to cover and protect the club head. An identifying tag embodying the present invention is attached to the cover, as by a flexible loop of elastic material. An identifying device or tag embodying the holds a set of reversible, interchangeable label plates side by side, exposing one face of one label plate through a display window defined by the holder portion of the identifying tag device, to display a number or other label. The label plates are held within the holder portion of the identification device by releaseable latches, and any one of the label plates can be placed in the holder with either side exposed through the display window, while the remaining label plates also fit securely latched into the holder, where they are available to be displayed when desired.

Preferably, the holder is of a tapered shape provided by a back wall, a front wall defining the display window, and a pair of side walls which converge toward the top of the holder, defining a wide mouth at the bottom of the holder. Resiliently supported catches located on each label plate latchingly engage respective shoulders provided near the top of the holder, and an opener tab or grip attached to each catch facilitates disengaging the catch from the shoulder to permit removal of each of the label plates when desired.

Preferably, a tongue is provided at the top of each label plate and a throat is defined inside the top portion of the holder, to facilitate manual release of the catches, by preventing the label plates from moving laterally in response to pressure on the opener tabs. The size of the label plates and the interior size of the holder are coordinated with the location of the catches so that the label plates are held securely and snugly in the holder with the label plates unable to move freely.

It is therefore a principal object of the present invention to provide a golf club head cover including an improved club identification device.

It is a further object of the present invention to provide an improved identification tag including a limited number of easily exchanged standard indicia.

It is a principal feature of the present invention that it provides an identification tag including a plurality of label plates, only one of which is displayed at any particular time, while the other label plates remain readily available to be displayed.

It is another feature of the present invention that it provides an identification device for a golf club head cover in which a plurality of label plates are held securely within a holder by individually releaseable latches.

It is yet a further feature of the present invention that it provides label plates which are reversible to permit display of either of a pair of opposite faces.

A principal advantage of the present invention is that it makes it more likely that a desired label will be available for use when desired.

Another important advantage of the present invention is that it provides an identification tag device that facilitates a change from one displayed indicium to another.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
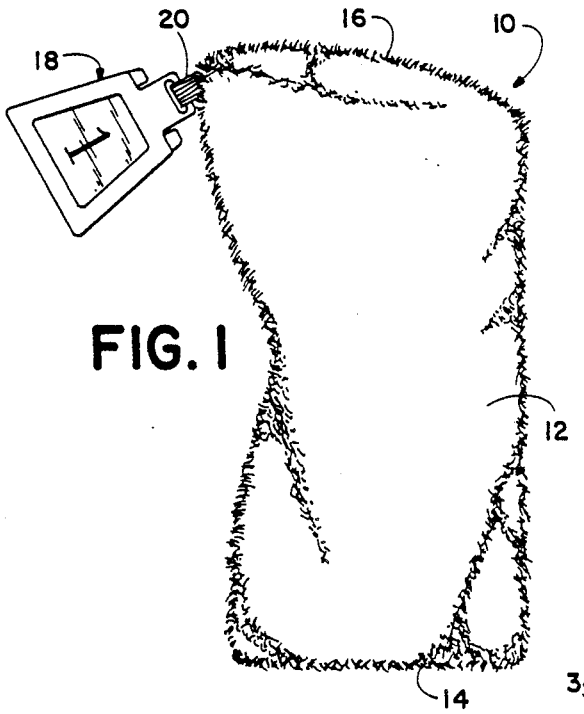
FIG. 1 is a pictorial view of a golf club head cover and club identification tag embodying the present invention.

Referring now to the drawings, in FIG. 1 a golf club head cover 10 is shown. The cover 10 includes a protective sleeve-like body 12 having an open bottom end 14 and a closed upper end 16. An identification tag 18 is attached to the upper end 16 of the body 12 by a strap which may be an elastic ribbon 20 or may be made of other suitable material. The elastic ribbon 20 may be sewn into a seam during manufacture of the body 12.

Referring now to FIGS. 2–5, the identification tag 18 includes a label plate holder 22 which may be molded of a suitable plastics material. The label plate holder 22 has a top 24 defining a loop 26 through which a suitable strap such as the elastic ribbon 20 may be placed to attach the identification tag to the body 12 of a club head cover.

The label plate holder 22 includes a back wall 28, a front wall 30, defining a label display window opening 32, and a pair of convergent side walls 34 and 36. The side walls 34 and 36 converge toward one another from the bottom of the label plate holder 22 where the back wall 28, front wall 30, and side walls 34, 36 define a mouth opening 38. The label plate holder 22 is thus tapered, with the back wall 28 and front wall 30 being generally parallel with one another, defining an interior space within the label plate holder 22 as a receptacle for label plates.

Three label plates 40, 42, and 44 are contained within the holder 22. Each of the label plates includes a neck portion 46 which fits within a throat portion 48 defined within the top portion 24 of the label plate holder 22. Each of the label plates includes a respective front face 50 and a rear face 52, with identifying indicia being imprinted on each face 50 or 52. For example, the numerals 1 and 7 are shown on the front face and rear face respectively of the label plate 40, while other numbers and letters are shown on the respective front faces 50 and rear faces 52 of the label plates 42 and 44. The numerals and letters shown on these faces are chosen to provide the user a selection of numbers representing various clubs, or, as shown on the rear face 52 of the label plate 42, a letter such as "X" to represent a special club. A manufacturer might choose also to provide a logo to be displayed on a face of one of the label plates, as is the letter in "J" on the rear face 52 of the label plate 44.

Figure 2:
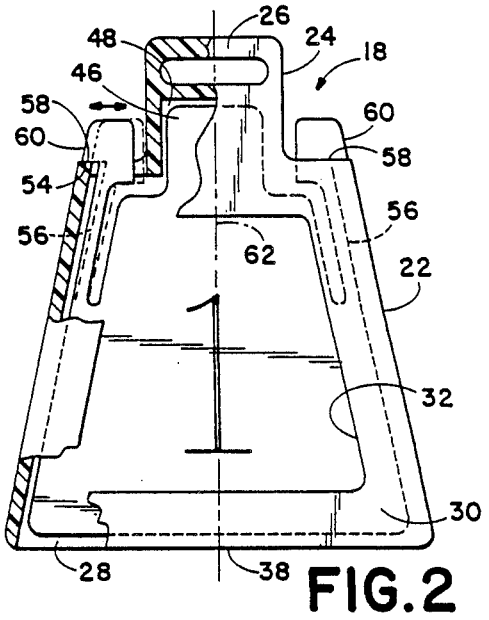
FIG. 2 is a partially cut-away front elevational view of an identification tag of the type shown in FIG. 1, at an enlarged scale.
Figure 3:
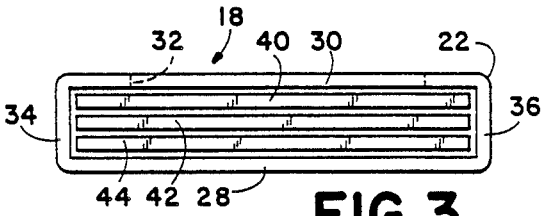
FIG. 3 is a bottom plan view of the identification tag shown in FIG. 2.
Figure 4:
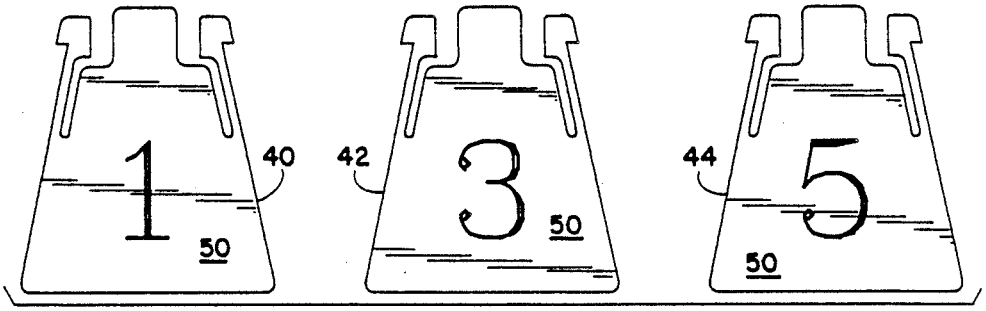
FIG. 4 is a front elevational view of each of three label plates included in the identification tag shown in FIGS. 2 and 3.
Figure 5:
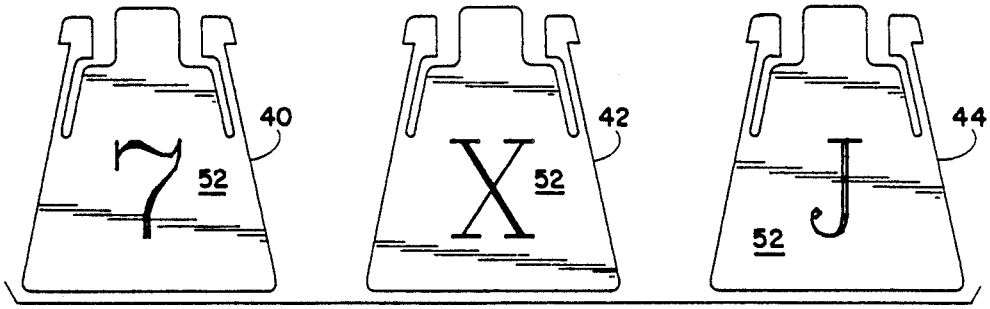
FIG. 5 is a rear elevational view of the label plates shown in FIG. 4.

The label plates 40, 42, and 44 are generally planar, as may be seen in FIGS. 2 and 3, and, as the holder 22, may be molded of a suitable plastic material. The overall shape of the label plates is generally trapezoidal and their size corresponds to the interior of the label plate holder 22, so that each of the label plates fits neatly within the interior of the label plate holder 22, and cannot be inserted into the label plate holder 22 beyond a limiting position, in which the edges of the label plates 40, 42, 44 will contact the interior of the side walls 34, 36, and the neck 46 may contact the interior of the throat portion 48 of the label plate holder 22.

The label plates are held within the label plate holder by the cooperative latching effect of the engagement of a pair of catches 54 carried on catch support members 56. The catches latch over respective shoulders 58 defined by the upper ends of the side walls 34 and 36. Each of the catch supports 56 is a resiliently flexible thin portion of the label plate 40, 42, or 44, permitting the catches 54 to be disengaged from the shoulders 58 by laterally inward pressure applied to openers 60 which extend upwardly beyond the catches 54.

The openers 60 can be engaged by a finger and thumb to squeeze the catches 54 inwardly toward the neck 46 of a label plate 40, 42, or 44 to disengage the label plate from the label plate holder 22 when desired. This bends the catch supports 56 resiliently inward as is shown in broken line at the left side of FIG. 2. The neck 46, located within the throat 48, stabilizes the location of each of the label plates as the openers 60 are squeezed inwardly so that both of the catches 54 can simultaneously be disengaged easily from the respective shoulders 58 as the label plates are released from within the label plate holder 22.

The shape of the interior of the label plate holder 22 and the correspondingly similar shape of each of the label plates 40, 42, 44 is laterally symmetrical, about an axis of symmetry 62 extending vertically in the plane of the label plate as shown in FIG. 2, so that each label plate can be rotated about the axis of symmetry 62 to direct either the front face 50 or the rear face 52 thereof toward the front wall 30 and the display window 32. When a particular club-identifying indicium, such as the numeral 1 shown on the front face 50 of the label plate 40, has been selected, the appropriate label plate is inserted, neck first, into the mouth 38 of the bottom of the label plate holder 22. The chosen label plate, in this case the label plate 40, is then urged upwardly into the interior of the label plate holder 22 until the neck 46 enters the throat 48 and the openers 60, cammed by contact against the interior of the side walls 34 and 36, force the catch supports 56 to bend resiliently far enough to permit the label plate 40 to be inserted all the way into the interior of the label plate holder 22. Once the openers 60 pass clear of the shoulders 58, the catches 54, under the influence of the resilient catch supports 56, move into place, latching over the shoulders 58 to retain the label plate 40 within the label plate holder 22. Similarly, the other label plates 42 and 44 are inserted into the interior of the label plate holder, between the label plate 40 and the back wall 28.

When one of the label plates 40, 42, and 44 is latched into the label plate holder 22 it is still free to move toward or away from the back wall 28 or front wall 30, so that only a single one of the label plates 40, 42, 44 which includes a desired club-identifying indicium on one of its faces need be removed from the label plate holder 22 in order to display the desired face of the selected label plate. For example, should it be desired to display the club-identifying indicium "X" shown on the rear face 52 of the label plate 42, the label plate 42 can be released from the label plate holder 22 by squeezing the openers 60 of the label plate 42 far enough together to release the catches 54 of the label plate 42 from the shoulders 58. The label plate 42 may then be withdrawn from the label plate holder 22 and rotated about the axis of symmetry 62 to expose the rear face 52 toward the window 32. The label plate 42 may then be installed within the interior of the label plate holder 22 by first pushing the label plate 40 rearwardly, toward the back wall 28, and inserting the label plate 42 adjacent the front wall 30, urging it into the label plate holder 22 until its catches 54 again latch against the shoulders 58.

It will be readily apparent that more or fewer than three label plates could be used, depending upon the number of different club-identifying indicia desired to be readily available for display, although three label plates is a preferred number in order to provide ample choice yet avoid the identification tag 18 becoming too bulky as a result of too many label plates.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An identification tag for use in conjunction with a golf club cover or the like, comprising:

(a) a plurality of generally planar label plates each having a pair of label faces, at least one label face including a club-identifying mark;

(b) a labelled plate holder including a top and a pair of sidewalls defining an interior space and a label display window; and (c) latching means included in said label plate holder said latching means including a retainer shoulder defined by one of said sidewalls at a location adjacent said top, each of said label plates including a resiliently flexible catch support member and catch means, carried on said catch support member and latchingly engageable with said retainer shoulder, for holding said label plates in said holder in face to face parallel alignment with one another and having one of said club identifying marks of one of said label plates visibly located in alignment with said display window.

2. The identification tag of claim 1 including a pair of said shoulders defined, respectively, by said side walls adjacent said top, wherein each of said label plates includes a pair of said catch supports located laterally opposite one another and respective catch means located on each of said supports.

3. The identification tag of claim 1 wherein said catch means includes an opener exposed adjacent said top of said holder when said label plate is latched in said holder, said opener being located with respect to said catch means so that pressure against said opener can move said catch means sufficiently to disengage said catch means from said retainer shoulder.

4. The identification tag of claim 3 wherein said holder has a top and defines a throat within said top and wherein each of said label plates includes a neck portion which fits within said throat when said label plate is properly located within said label plate holder, said neck fitting snugly enough within said throat to restrict said label plate against lateral motion within said holder to the extent that said catch means can be disengaged from said retainer shoulder by pressure on said opener.

5. The identification tag of claim 1 wherein said label plate holder includes generally parallel front and back walls and a pair of convergent side walls interconnecting said front and back walls, said front and back walls and side walls cooperatively defining a receptacle having a mouth and said holder having a top located opposite said mouth, each of said label plates having a size so related to the size of said receptacle that said label plates can be inserted into said receptacle to a limiting location, and said latching means engaging said label plates with said label plate holder only when said label plates approach said limiting position and said latching means thereafter retaining said label plates within said label plate holder substantially in said limiting location.

6. The identification tag of claim 1 wherein said label plate holder includes generally parallel front and back walls spaced apart from one another and interconnected with one another by a pair of side walls, said label plates being slidable within said housing in either direction between different positions within said label plate holder respectively nearer said front wall and nearer said back wall when fewer than a maximum number of said label plates are located latched into said interior space within said label plate holder.

* * * * *

UNITED STATES PATENT AND TRADEMARK OFFICE

CERTIFICATE OF CORRECTION

PATENT NO. : 4,991,338

DATED : February 12, 1991

INVENTOR(S) : George H. Jones

It is certified that error appears in the above-identified patent and that said Letters Patent is hereby corrected as shown below:

Column 2, line 4, delete "embodying the".

Signed and Sealed this

Fourth Day of August, 1992

*Attest:*

DOUGLAS B. COMER

*Attesting Officer*

*Acting Commissioner of Patents and Trademarks*